US007776793B2

(12) United States Patent
Watanabe et al.

(10) Patent No.: US 7,776,793 B2
(45) Date of Patent: Aug. 17, 2010

(54) SYSTEM AND METHOD FOR POLISHING SURFACE OF TAPE-LIKE METALLIC BASE MATERIAL

(75) Inventors: Takehiro Watanabe, Tokyo (JP); Sanaki Horimoto, Tokyo (JP); Takuya Nagamine, Tokyo (JP); Yuji Horie, Tokyo (JP)

(73) Assignee: Nihon Micro Coating Co., Ltd., Tokyo (JP)

( * ) Notice: Subject to any disclaimer, the term of this patent is extended or adjusted under 35 U.S.C. 154(b) by 0 days.

(21) Appl. No.: 12/064,942

(22) PCT Filed: Jul. 5, 2007

(86) PCT No.: PCT/JP2007/063419

§ 371 (c)(1),
(2), (4) Date: Feb. 26, 2008

(87) PCT Pub. No.: WO2008/004601

PCT Pub. Date: Jan. 10, 2008

(65) Prior Publication Data

US 2009/0163122 A1 Jun. 25, 2009

(30) Foreign Application Priority Data

Jul. 5, 2006 (JP) ..... 2006-185455

(51) Int. Cl.
*H01L 39/24* (2006.01)

(52) U.S. Cl. ..... 505/430; 451/57; 451/184; 451/260; 451/36

(58) Field of Classification Search ..... 505/430; 451/57, 184, 260, 36
See application file for complete search history.

(56) References Cited

U.S. PATENT DOCUMENTS 5,355,632 A * 10/1994 Horie ..... 451/1
6,491,572 B1 * 12/2002 Horie et al. ..... 451/63
6,755,722 B1 * 6/2004 Horie et al. ..... 451/41
6,908,362 B2 * 6/2005 Selvamanickam et al. ..... 451/28
6,974,368 B2 * 12/2005 Horie et al. ..... 451/36
7,631,419 B2 * 12/2009 Okuyama et al. ..... 29/737
2005/0238927 A1 * 10/2005 Horie et al. ..... 428/846.9
2006/0003092 A1 * 1/2006 Horie et al. ..... 427/127
2008/0049347 A1 * 2/2008 Okuyama et al. ..... 360/39
2009/0054243 A1 * 2/2009 Horie et al. ..... 505/701

FOREIGN PATENT DOCUMENTS

JP 04019057 A * 1/1992
JP 05329758 A * 12/1993
JP 07254147 A * 10/1995
JP 2001001240 A * 1/2001
JP 2001162504 A * 6/2001
JP 2001347446 A * 12/2001
JP 2002166342 A * 6/2002
JP 2008049451 A * 3/2008

OTHER PUBLICATIONS

International Search Report, PCT/JP2007/063419, 4 pages, Aug. 14, 2007.*

* cited by examiner

*Primary Examiner*—Douglas Mc Ginty
(74) *Attorney, Agent, or Firm*—Weaver Austin Villeneuve & Sampson LLP

(57) ABSTRACT

A polishing system and a method are presented for uniformly polishing efficiently at a fast rate the surface of a tape-like metallic base material of several hundred meters in length. The polishing system is provided not only with devices for causing the base material to travel continuously and applying a specified tension in the base material but also with a first polishing device for randomly polishing the target surface and a second polishing device for carrying out a final polishing on the target surface in the direction of travel of the base material. Polishing marks are formed in the direction of travel on the target surface by the final polishing.

18 Claims, 8 Drawing Sheets

SYSTEM AND METHOD FOR POLISHING SURFACE OF TAPE-LIKE METALLIC BASE MATERIAL

This application is a National Stage Application under 35 USC §371 of International Application No. PCT/JP2007/63419, filed Jul. 5, 2007 which claims priority on Japanese Patent Application 2006-185455 filed Jul. 5, 2006.

BACKGROUND OF THE INVENTION

This invention relates to a device and a method for polishing the surface of a tape-like metallic base material to a specified level of roughness, and more particularly to a polishing system and a polishing method for a tape-like metal serving as a base material for forming a functional thin film with the characteristic of superconductivity, ferroelectricity or ferromagnetism.

The surface processing of a material for a base plate is an important problem for products with a functional film formed and used above a tape-like metallic base material. A tape-like metallic base material is fabricated in the form of a tape generally by the process of cold rolling or hot rolling. By such a fabrication process, however, desired characteristics of a functional thin film cannot be obtained because of the scratches and crystalline defects caused by the rolling unless they are removed. For this reason, processes of not only removing scratches or crystalline defects but also making the surface flat and smooth have been practiced. Japanese Patent Publications Tokkai 8-294853 and 2001-269851 which are herein incorporated by reference, for example, have disclosed a device for and a method of polishing while pressing a traveling metallic belt of stainless steel onto a rotationally driven endless polishing belt. By either of these processes, however, the finally obtainable surface roughness is of the order of microns, which is not sufficient for forming a functional thin film thereupon. Depending upon the kind of the functional thin film to be formed, its characteristics are affected significantly by the crystalline characteristics of the surface of the tape-like metallic base material and the orientation characteristics of the crystal.

On the other hand, technologies for forming various types of orientation films on a polycrystalline base material are being utilized. In the fields of optical thin films, photomagnetic disks, wiring substrates, high-frequency transmission waveguides or filters and cavity resonators, for example, it is becoming a problem to form on a substrate a polycrystalline thin film having a good orientation characteristic with stable film quality. It is even more desirable to be able to form an optical thin film, a magnetic thin film or a wiring thin film with a good crystalline orientation characteristic directly on a base material since if the crystalline characteristic of the polycrystalline thin film is good, the film quality of the optical thin film, the magnetic thin film or the wiring thin film formed thereon is improved.

In recent years, superconducting oxides are coming to be attracting attention as superior superconductors with critical temperatures exceeding the temperature of liquid nitrogen but there are problems in order to put superconducting oxides of this kind into a practical use. One of these problems is the low critical current densities of superconducting oxides, and one of the big reasons for this is that the crystals of these superconducting oxides themselves have electrical anisotropy. It is known in particular that it is easy for an electric current to flow inside a superconducting oxide in the directions of a-axis and b-axis but it is difficult in the direction of the c-axis. In order to form a superconducting oxide on a base material and to use it as a superconducting body, therefore, it is necessary to form a superconducting oxide with good crystalline orientation characteristics on the base material, to orient the a-axis or the b-axis of the crystals of the superconducting oxide in the direction in which an electric current is to be passed, and to orient the c-axis of the superconducting oxide in another direction. U.S. Pat. No. 6,908,362, which is herein incorporated by reference, discloses such a method by forming a film of superconducting oxide after the surface of a tape of nickel or a nickel alloy is finely polished. Japanese Patent Publications Tokkai 6-145977 and 2003-36742, which are also herein incorporated by reference, disclose another method of providing an intermediate layer with controlled crystalline orientation on the surface of an elongated tape-like metallic base material and forming thereon a thin film of a superconducting oxide. The bonding characteristic among the crystalline particles is improved by this method and a high critical current density can be obtained.

All these prior art technologies indicate that it is important to polish the surface of the base material so as to make it flat and smooth. In order to accomplish even high critical current densities, however, it is necessary to form the surface of the tape-like metallic base material such that the surface is not only sufficiently flat but also easy to orient the crystals. It is therefore necessary that the surface of the tape-like metallic base material for forming the thin film be polished and finished uniformly on the order of nanometers and that a surface with good crystalline orientations be formed. It is also necessary to prevent oxide films or unwanted foreign objects from becoming attached to the finished surface. Since base materials to be used as a superconducting coil are processed in units of several hundred meters, furthermore, it is further necessary to polish the surface of such base material continuously at a high speed and uniformly to a surface roughness on the order of nanometers.

SUMMARY OF THE INVENTION

It is therefore an object of this invention in view of the present situation described above to provide a surface polishing system and a polishing method such that the crystalline orientation characteristic of the surface of a thin and elongated (hereinafter referred to as "tape-like" or "tape-shaped") metallic base material can be improved for increasing the critical current.

Another object of this invention is to provide a polishing system and a polishing method for uniformly polishing the surface of a tape-like metallic base material with a high speed efficiently in units of several hundred meters.

According to one embodiment of this invention, a polishing system for continuously polishing a target surface of a tape-shaped metallic base material comprises a feeding device for causing the base material to travel continuously, a pressing device for applying a specified tension in the base material, a first polishing device for randomly polishing the target surface, and a second polishing device for carrying out a final polishing on the target surface in the direction of travel of the base material wherein polishing marks are formed in the direction of travel on the target surface by the final polishing.

In the above, the first polishing device may include at least one polishing station that comprises a polishing head that causes a polishing tape which is continuously sent out to rotate around an axial line perpendicular to the target surface, and a pressing mechanism for pressing the tape-shaped metallic base material onto the polishing tape.

Likewise, the second polishing device may include at least one polishing station that comprises a polishing head having a cylindrical polishing drum that rotates in the direction of travel of the base material, and a pressing mechanism for pressing the tape-shaped metallic base material onto the polishing drum.

Moreover, the first polishing device may include at least one polishing station that comprises a polishing head having a polishing pad that is attached to a platen and a mechanism for causing the polishing pad to rotate around an axial line perpendicular to the target surface, and a pressing mechanism for pressing the tape-shaped metallic base material onto the polishing pad.

Furthermore, the second polishing device may include at least one polishing station that comprises a polishing head having a tape member that rotates in the direction of travel of the tape-shaped metallic base material, and a pressing mechanism for pressing the tape-shaped metallic base material onto the tape member.

According to a preferred embodiment, the polishing station may have a first stage and a second stage each including a polishing head, the polishing head of the first stage and the polishing head of the second stage rotating in mutually opposite directions.

Likewise, the polishing station may have a first stage and a second stage each including a polishing head, the polishing head of the first stage and the polishing head of the second stage rotating in a direction opposite to the direction of travel.

The polishing system of this invention may additional comprise a washing device that washes the tape-shaped metallic base material after undergoing a polishing process.

Moreover, the polishing system of this invention may also comprise a width-regulating member that prevents positional displacement of the tape-shaped metallic base material.

In another aspect of the present invention, a method of polishing a tape-shaped metallic base material by using a polishing system of this invention comprises the process of causing the base material to travel by the feeding device at a speed of 20 m/h or faster, a first polishing process of polishing the target surface of the base material randomly by the first polishing device, and a second polishing process of polishing the target surface in the direction of travel of the base material by the second polishing device.

The method may additionally comprise the process of supplying slurry as the target surface is polished.

More in detail, the slurry may comprise abrading particles, water and a mixture obtained by adding an additive to water, the abrading particles being of one kind or more selected from the group consisting of $Al_2O_3$, $SiO_2$, colloidal silica, fumed silica, monocrystalline and polycrystalline diamond, cBN and SiC.

As a preferred embodiment of this invention, the average particle diameter of the abrading particles in the slurry used in the first polishing process is 0.05 μm-3 μm and the average particle diameter of the abrading particles in the slurry used in the second polishing process is 0.03 μm-0.2 μm.

Moreover, the first polishing process may include the step of polishing the target surface such that the average surface roughness Ra of the target surface becomes 10 nm or less.

Likewise, the second polishing process may include the step of polishing the target surface such that the average surface roughness Ra of the target surface becomes 5 nm or less and forming polishing marks on the target surface in the direction of travel of the base material.

The method of this invention may additionally comprise the step of washing the base material after the polishing processes.

DETAILED DESCRIPTION OF THE INVENTION

In what follows, the invention is described with reference to the drawings but the examples described herein are not intended to limit the scope of the invention.

Examples of material for the tape-like (tape-shaped) metallic base material which is to be polished by a polishing system of this invention include at least nickel, nickel alloys, stainless steels, copper and silver. Such materials are fabricated into the shape of a tape with a thickness in the range of 0.05 mm-0.5 mm, a width in the range of 2 mm-100 mm and a length of several hundred meters by a rolling technology. The metallic rolling material is a polycrystalline material, having a crystalline structure oriented in the direction of the rolling.

This tape-like metallic base material has linear scratches or crystalline defects in the direction of the rolling. The invention provides a polishing system for firstly removing such surface scratches formed by the rolling or crystalline defects by a random rotational polishing method so as to reduce the average surface roughness Ra down to 10 nm or less and preferably 5 nm or less and thereafter carrying out a final polishing step such that polishing marks will remain in the direction of travel and reducing the average surface roughness Ra to 5 nm or less and preferably 1 nm or less.

By a polishing system of this invention, a transmission speed of 20 m/h-250 m/h becomes possible.

Figure 1:
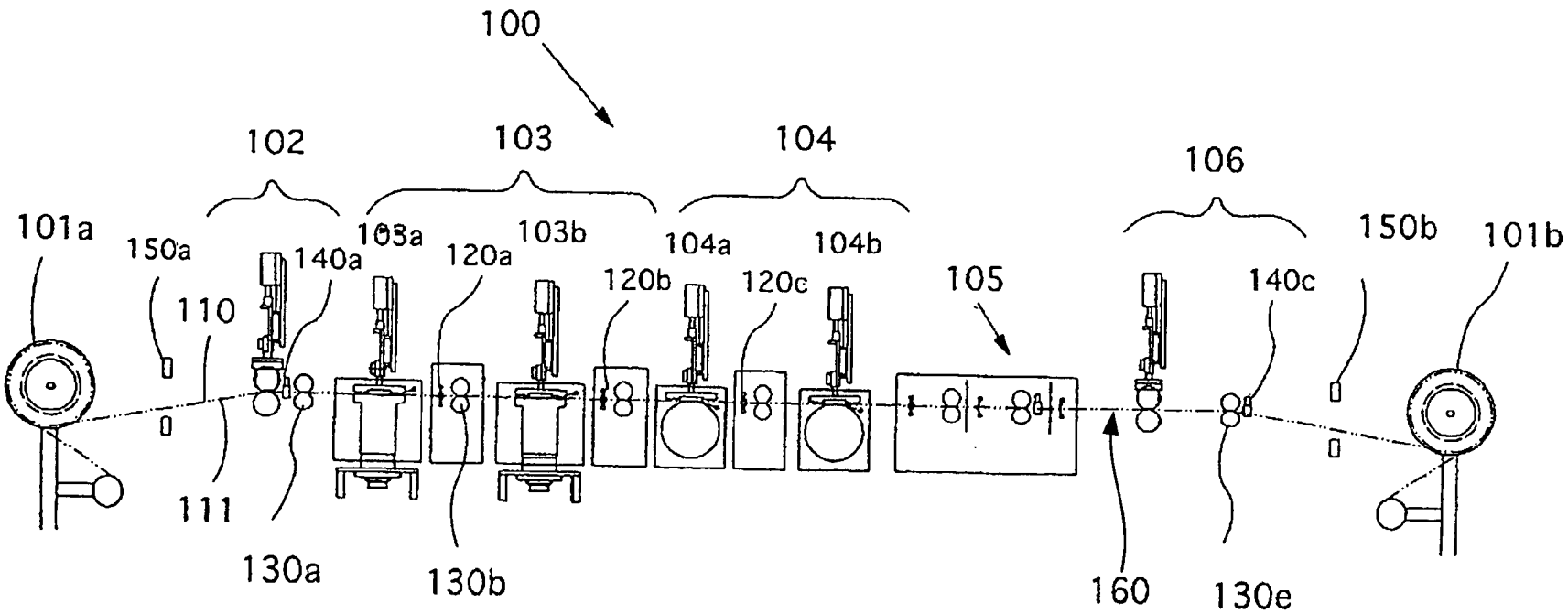
FIG. 1 shows schematically an example of polishing system according to this invention.

Next, an outline of the structure and operations of a polishing system according to this invention will be presented and details of its constituent parts will be explained thereafter. FIG. 1 shows schematically a preferred example of polishing system of this invention. A polishing system 100 of this invention comprises a tape-supplying part 101*a*, a back tension part 102, a first polishing part 103, a second polishing part 104, a washing part 105, an inspection part 160, a tape transporting part 106 and a tape wind-up part 101*b*.

A tape-like metallic base material 110 wound around a feeder reel of the tape-feeding part 101*a* is passed through the back tension part 102 to enter the first polishing part 103. Inside the first polishing part 103, a first polishing process to be described in detail below is firstly carried out on the tape-like base material 110. Next, the tape-like base material 110 advances into the second polishing part 104 where a second polishing process to be described also in detail below is carried out. The tape-like base material 110 is thereafter brought into the washing part 105 where a final washing process is carried out. The surface roughness Ra and polishing marks on the tape-like base material 110 thus finished are thereafter observed in the inspection part 160 to be described in detail below. Thereafter, the tape-like base material 110 is passed through the tape transporting part 106 and finally wound up around a wind-up reel of the wind-up part 101*b*.

It is preferable to carry out washing of the tape-like base material 110 with water (120*a*, 120*b* and 120*c*) after the polishing process such that residual abrading particles, polishing debris and residual slurry can be removed.

As will be explained in detail below, the motion of the tape-like base material 110 is controlled at a specified tension by means of the back tension part 102 and the tape transporting part 106. Moreover, a plurality of width-regulating guide members 140*a*, 140*b* and 140*c* are disposed at appropriate intervals in order to prevent positional displacements of the tape-like base material 110 as will be described in detail below. Looseness-detecting sensors 150*a* and 150*b* are disposed on the downstream side of the feeder reel and the upstream side of the wind-up reel to detect the loosened condition of the tape-like base material 110 such that the rotational speed of the wind-up reel can be controlled.

Next, a preferred example of polishing method according to this invention is described although the invention is not intended to be limited thereby and many modifications and variations are possible within the scope of this invention.

A polishing method for the tape-like metallic base material 110 according to this invention comprises a first polishing process and a second polishing process. The object of the first polishing process is to remove the scratches, protrusions and/or crystalline defects on the surface of the tape-like metallic base material 110 formed by rolling.

Explained more in detail, a polishing process is carried out by placing a polishing pad or a polishing tape on the main surface of a polishing head, pressing it from behind by means of a pressing mechanism while the polishing pad or the polishing tape is rotated around an axial line perpendicular to the target surface to be polished. The direction of rotation may be either clockwise or counter-clockwise. If the polishing is carried out in a plurality of stages, it is preferable to alternate the direction of rotation. Alternatively, the direction of rotation may be kept the same while the center of rotation of the polishing pad or the polishing tape is displaced in the opposite direction with respect to the tape-like base material such that the direction of polishing is reversed. It is because the fabrication efficiency and the surface accuracy can be thereby improved.

It is also preferable to add slurry comprising abrading particles, water and an additive added to water onto the surface of the polishing pad or the polishing tape at the time of the polishing. Examples of the abrading particles include $Al_2O_3$, $SiO_2$, colloidal silica, fumed silica, (monocrystalline or polycrystalline) diamond cBN and SiC.

The polishing tape may be fed while it is caused to rotate within the surface of the tape-like base material to polish it. A pad of a resin material may be pasted onto a platen and rotated for the polishing process.

If the first polishing process is divided into a plurality of stages, the process may be arranged such that abrading particles with larger diameters are used first and the size of the abrading particles is reduced gradually until the polishing for the finish.

As a result of the first polishing process, the surface roughness Ra of the tape-like base material 110 can be reduced to 10 nm or less or preferably 5 nm or less.

Next, the second polishing process is explained. The object of the second polishing process is to remove the random polishing marks formed on the surface of the tape-like base material by the first polishing process, to form polishing marks in the direction of travel of the tape-like base material and to increase the crystalline directionality of the tape-like base material in its longitudinal direction.

Explained more in detail, the polishing process is carried out by rotating a cylindrical drum with a pad of a resin material wrapped therearound and affixed thereto or feeding a polishing tape (say, comprising a woven cloth, an unwoven cloth or foamed polyurethane) in or against the direction of the tape-like base material. It is preferable to apply slurry on the surface of the polishing pad or the polishing tape at the time of polishing. Examples of abrading particles to be used include $Al_2O_3$, $SiO_2$, colloidal silica, fumed silica, (monocrystalline or polycrystalline) diamond cBN and SiC.

Additionally, the second polishing processes may be carried out in a plurality of stages. The speed of polishing may thus be improved.

As a result of the second polishing process, the surface roughness Ra of the tape-like base material 110 can be reduced to 5 nm or less or preferably 1 nm or less such that the crystalline directionality of the intermediate layer and the superconducting member can be improved.

Next, each of the devices forming the polishing system of this invention is explained in detail. Since the target object to be polished according to this invention is a tape-like metallic base material having an extremely special structure with a thickness in the range of 0.05 mm-0.5 mm, a width in the range of 2 mm-100 mm and a length of several hundred meters, various features must be incorporated to the polishing system.

Figure 2A:
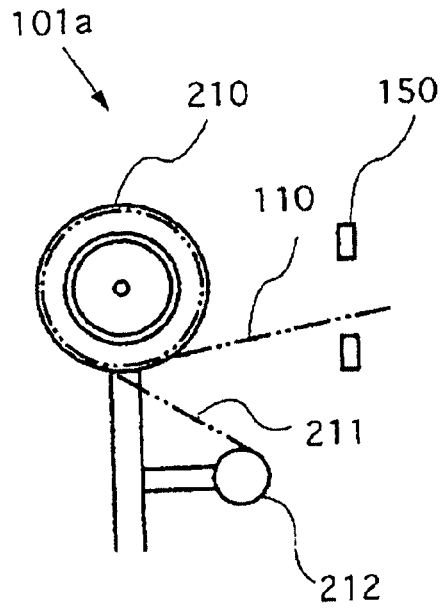
FIGS. 2A and 2B respectively show the feeder and wind-up mechanisms for the tape-like metallic base material used by the polishing system of this invention.
Figure 2B:
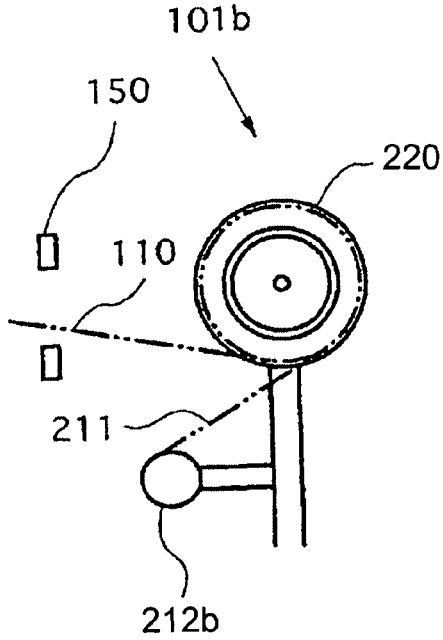

FIGS. 2A and 2B respectively show the tape-feeding part 101*a* and the wind-up part 101*b* in enlarged ways. The tape-feeding part 101*a* comprises a feeder reel 210 around which the tape-like metallic base material 110 is wound and a looseness-detecting sensor 150. A protective paper wind-up reel 212 may additionally be included if protective paper or film 211 is attached to the surface of the tape-like metallic base material. The wind-up part 101*b* includes a wind-up reel 220, another looseness-detecting sensor 150 and a feeder reel 212*b* for the protective paper or film 211 and is symmetrically structured with respect to the tape-feeding part 101*a*.

The tape-like metallic base material 110, having been pulled out from the feeder reel 210, is transported into the polishing system 100 and then subjected to a specified tension by a back tension mechanism to be described in detail below. If protective paper or film 211 is wrapped between the tape-like metallic base material parts, it is wound up around the wind-up reel 212 simultaneously. A looseness-detecting sensor 150 is disposed between the tape-feeding part 101*a* and the back tension part 102 for detecting the looseness in the tape and thereby controlling the speed of motor rotation for the feeder reel 210 and the wind-up reel 220. This is for the purpose of preventing damage caused by an excessive tension and disorder caused by looseness. Examples of feeding and wind-up devices that may be used for the purpose of this invention include ARV50C/100C, TRV20B, ARV50C/100C and TRV20B (trade names) produced by Futaba Denshi Kogyo Kabushiki Kaisha.

As explained above, a proper tension is applied to the tape-like base material 110 by the back tension part 102 and the tape transporting part 106 while the polishing process is carried out.

Figure 3A:
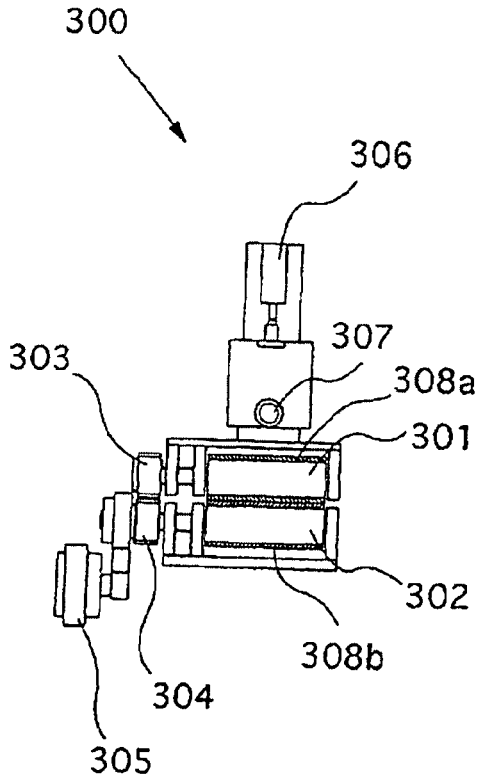
FIGS. 3A and 3B are respectively a front view and a side view of the back tension roller part of the polishing system of this invention.
Figure 3B:
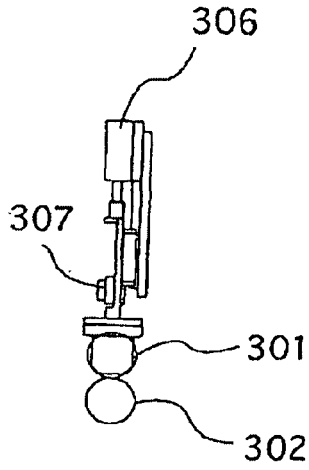

The back tension part comprises a roller driving mechanism 300, a width regulating guide member 140*a* and tape receiving rollers 130*a*. FIGS. 3A and 3B are respectively a front view and a side view of the roller driving mechanism 300. As shown in FIG. 3A, an upper roller 301 and a lower roller 302 are disposed parallel to each other, being connected through connecting gears 303 and 304. A power brake 305 is connected to these connecting gears for controlling tension. An air cylinder (as a pressure cylinder) 306 is disposed above the rollers for controlling the pressure to the rollers. An adjustment bolt 307 is disposed above the upper roller 301 for adjusting the parallel relationship between the upper roller 301 and the lower roller 302. The roller surfaces 308*a* and 308*b* respectively of the upper and lower rollers 301 and 302 are each covered with a pad of a resin material (such as polyurethane and urethane rubber) with hardness 90 degrees. According to a preferred embodiment of this invention, the maximum compressing pressure is 60 kg and the maximum back tension applied onto the tape-like metallic base material is 12 N/m.

The width-regulating guide member 140*a*, to be explained in detail below, is disposed on the downstream side of the roller driving mechanism 300, and the tape receiving rollers 130*a* are disposed still further downstream thereto. Their numbers and the interval therebetween may be determined freely.

Figure 11A:
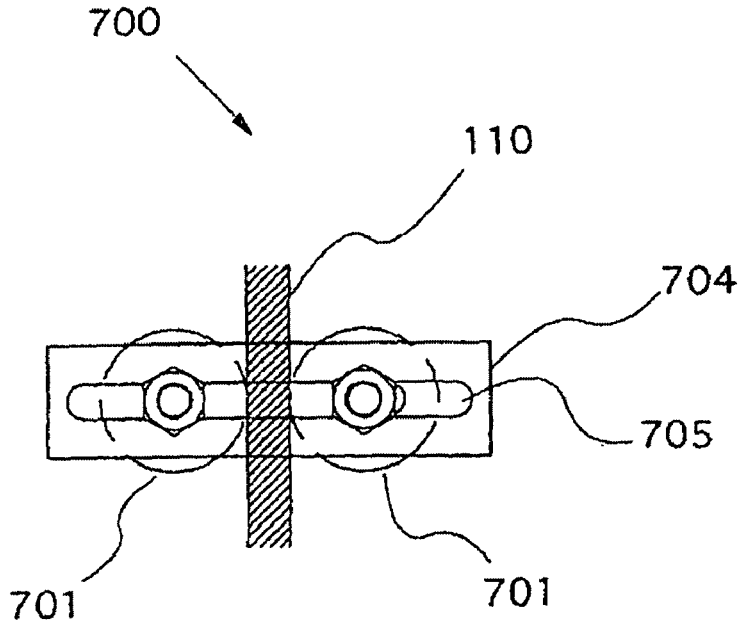
FIGS. 11A, 11B and 11C are respectively a plan view, a front view and a side view of a width-regulating guide member used in the polishing system of this invention.
Figure 11B:
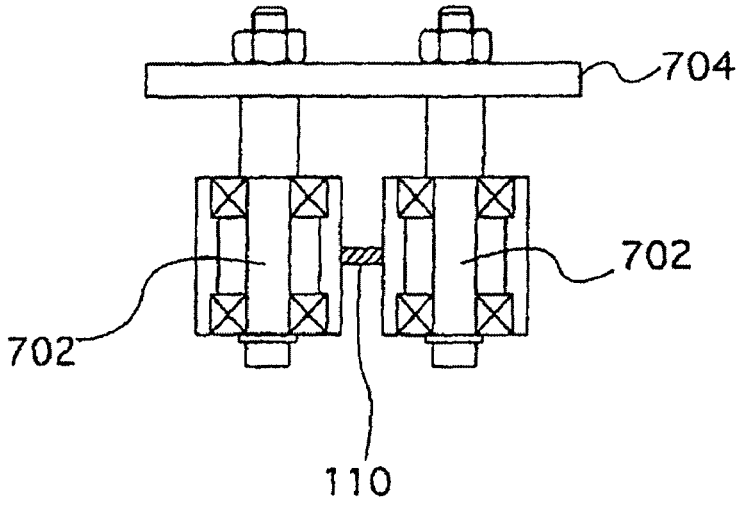
Figure 11C:
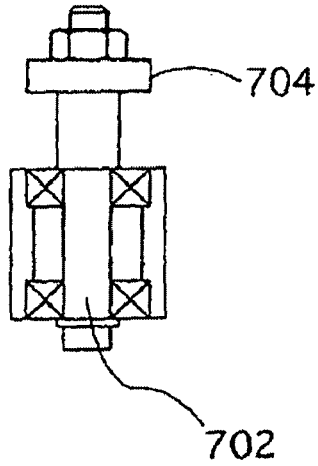

FIGS. 11A, 11B and 11C are respectively a plan view, a front view and a side view of a preferred example of width-regulating guide member 700 used in the polishing system of this invention although the guide members of this invention are not intended to be limited thereby. The width-regulating guide member 700 comprises two columnar rollers 701 separated from each other by a distance corresponding to the width of the tape-like base material 110, stainless shafts 702 which axially and rotatably support the rollers 701 and a supporting plate 704 for supporting the two shafts 702. The rollers 701 may be made of a resin material such as polyethylene and polypropylene. The supporting plate 704 is provided with a groove 705 such that the shafts 702 may be caused to slide therein to adjust the distance between the width adjusting rollers 701.

Figure 10A:
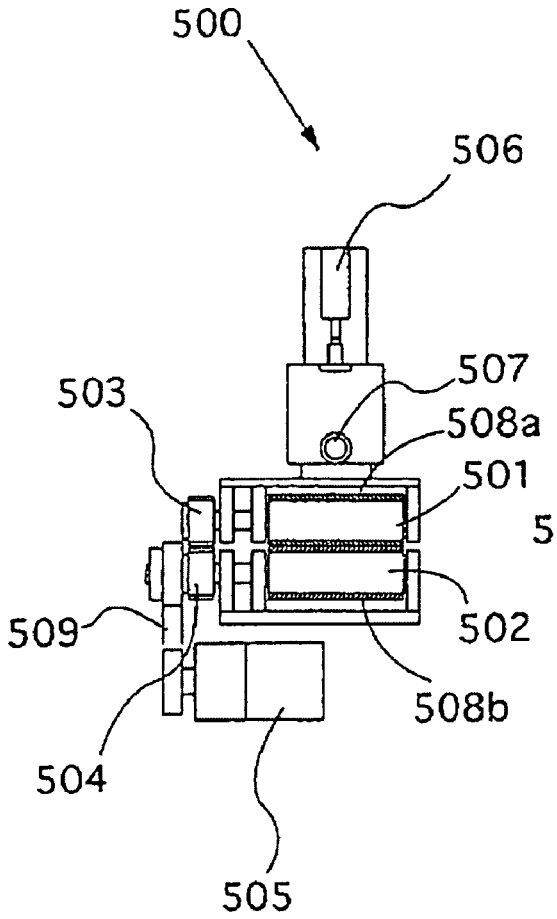
FIGS. 10A and 10B are respectively a front view and a side view of the nip roller driving mechanism used in the polishing system of this invention.
Figure 10B:
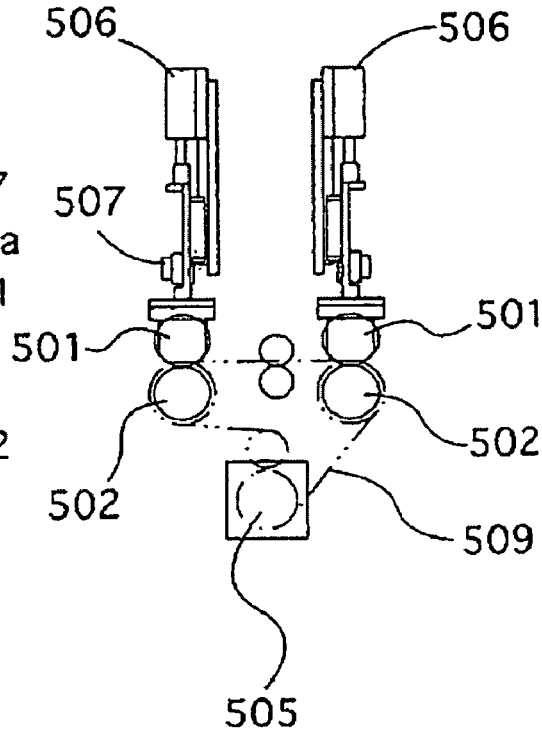

The tape transporting part 106 comprises a nip roller driving mechanism 500, the width-regulating guide member 140*c* and tape receiving rollers 130*e*. FIGS. 10A and 10B are respectively a front view and a side view of the nip roller driving mechanism 500. As shown in FIG. 10A, an upper roller 501 and a lower roller 502 are disposed parallel to each other and connected together by connecting gears 503 and 504. A driver motor 505 is disposed below the lower roller 502. An endless belt 509 is passed over the connecting gear 504 and the driver motor 505 such that the rotary power of the driver motor 505 is communicated to the lower roller 502. An air cylinder (as a pressure cylinder) 506 is disposed above the rollers for controlling the pressure to the rollers. An adjustment bolt 507 is disposed above the upper roller 501 for adjusting the parallel relationship between the upper roller 501 and the lower roller 502. The roller shafts of the nip roller driving mechanism 500 may be made of stainless steel. The roller surfaces 508*a* and 508*b* respectively of the upper and lower rollers 501 and 502 are each covered with a pad of a resin material (such as polyurethane and urethane rubber) with hardness 90 degrees.

As shown in FIG. 10B, two of such nip roller driving mechanisms 500 are provided according to a preferred embodiment of the invention so as to eliminate looseness in the tape-like metallic base material 110.

The compressive pressure by the air cylinder has a maximum value of 60 kg and is variable within the range of 5 $kg/cm^2$-0.5 $kg/cm^2$. The pressure conditions are appropriately adjusted by the back tension part 102 and the tape transporting part 106 according to the type, shape and finished condition of the tape-like metallic base material 110, and the tape-like metallic base material 110 is maintained at a fixed tension between them.

The tape receiving rollers 130*e* are disposed on the downstream side of the roller driving mechanisms 500. The width-regulating guide member 140*c* is disposed further downstream thereto. The numbers and the intervals of the width-regulating guide members and the tape receiving rollers may be varied freely.

The tape-like metallic base material 110 under a fixed tension is subjected to the first polishing process by the first polishing part 103. Although FIG. 1 shows the polishing system adapted to polish the lower surface 111 of the tape-like metallic base material 110, this is not intended to limit the scope of the invention. The polishing system may be adapted to polish the upper surface of the tape-like base material.

Figure 4B:
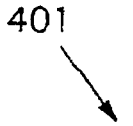
FIGS. 4A, 4B and 4C are respectively a front view, a plan view and a side view of a polishing head of the first polishing part used in the polishing system of this invention.
Figure 4B:
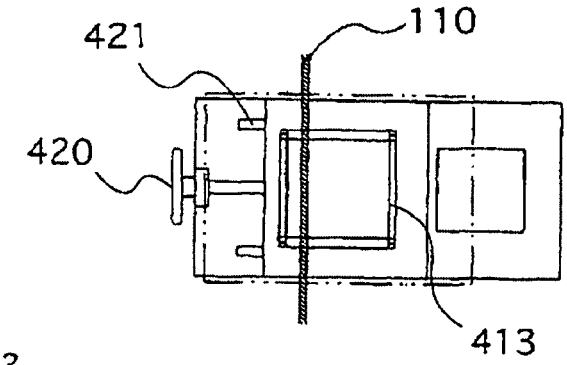
Figure 4A:
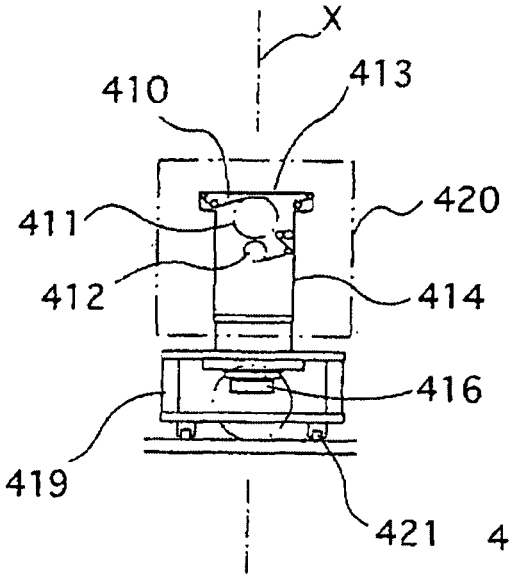
Figure 4C:
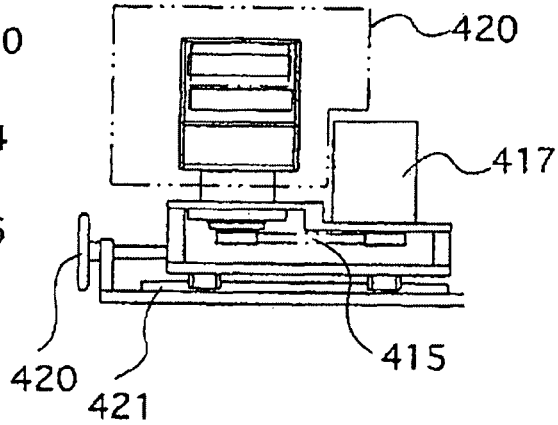

The first polishing part 103 comprises at least one polishing station (two shown in FIG. 1 at 103*a* and 103*b*) each including a polishing head 401 and a pressing mechanism 440 and one or more washing devices (two shown in FIG. 1 at 120*a* and 120*b*) each on the downstream side of the corresponding polishing station. FIGS. 4A, 4B and 4C are respectively a front view, a plan view and a side view of a preferred example of polishing head 401. The polishing head 401 comprises a feeding mechanism for sending a polishing tape 410 to a polishing table 413 and a rotating mechanism for rotating the polishing table 413 around an axial line x perpendicular to the polishing surface.

The feeding mechanism comprises a feeding reel 411 having the polishing tape 410 wound around it, at least one supporting roller, a take-up reel 412 for winding up the polishing tape 410 after the polishing and a driving motor (not shown) dynamically connected to the feeding reel 411 and the take-up reel 412. They are all contained inside a housing 414. A woven or non-woven cloth made of synthetic fibers or a tape made of a foamed material can be used as the polishing tape 410. The housing 414 is covered by a covering material 420 for preventing slurry from flying off during the polishing. As the motor is operated, the polishing tape 410 is sent out of the feeding reel 411, passes over the polishing table 413 through the supporting reel and is finally wound up around the take-up reel 412. An unused portion of the polishing tape 410 is always being supplied on the polishing table 413 for polishing the target surface of the tape-like metallic base material 110. It is preferable to supply the slurry as explained above while the polishing process is carried out.

The rotating mechanism comprises a spindle 416 which is disposed below the housing 414 and is coaxially connected to the aforementioned rotary axis x of rotation of the polishing table 413, a motor 417 and a belt 415 for communicating the rotational power of the motor 417 to the spindle 416. A supporting table 419 for supporting the motor 417 and the housing 414 is also provided. The spindle 416 is inside the supporting table 419 and is attached to it rotatably. The supporting table 419 is carried on two rails 421, and a handle 420 for moving the polishing station on the rails is connected to the supporting table 419. As the motor 417 is driven, its rotary power is communicated through the belt 415 to the spindle 416 and the housing 414 is rotated around the axial line x. The polishing station may be provided with a plurality of stages. In such a case, the polishing efficiency can be improved by reversing the direction of rotary motion of the housing (that is, the direction of rotation of the polishing tape).

Figure 4D:
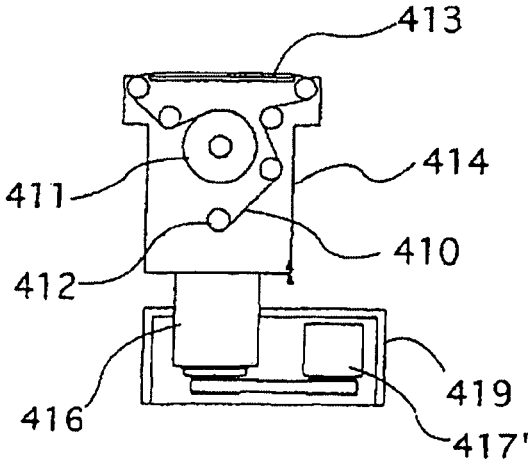
FIG. 4D shows another example and FIG. 4E shows still another variation example.

FIG. 4D shows a variation wherein a motor 417' is contained inside the supporting table 419.

Figure 4E:
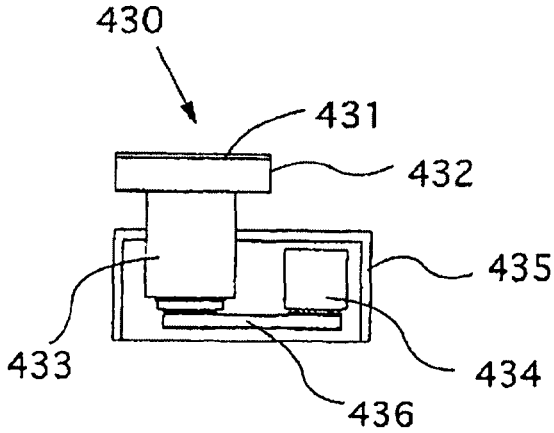

FIG. 4E shows another polishing head 430 according to a different embodiment of the invention. In this embodiment, a polishing pad is being used instead of a polishing tape. Thus, the polishing head 430 comprises a platen 432 having pasted thereon a polishing pad 431 for polishing the tape-like base material 110, a spindle 433 supporting the platen 432, a belt 436 and a motor 434. The spindle 433 is rotatably attached to a supporting table 435, and the motor 434 is contained inside the supporting table 435. As the motor 434 is driven, its rotary power is communicated to the spindle 433 through the belt 436 such that the polishing pad 431 is rotated to polish the tape-like base material 110. It is preferable to supply aforementioned slurry nearly onto the center of the polishing pad 431 when the polishing process takes place.

Figure 5A:
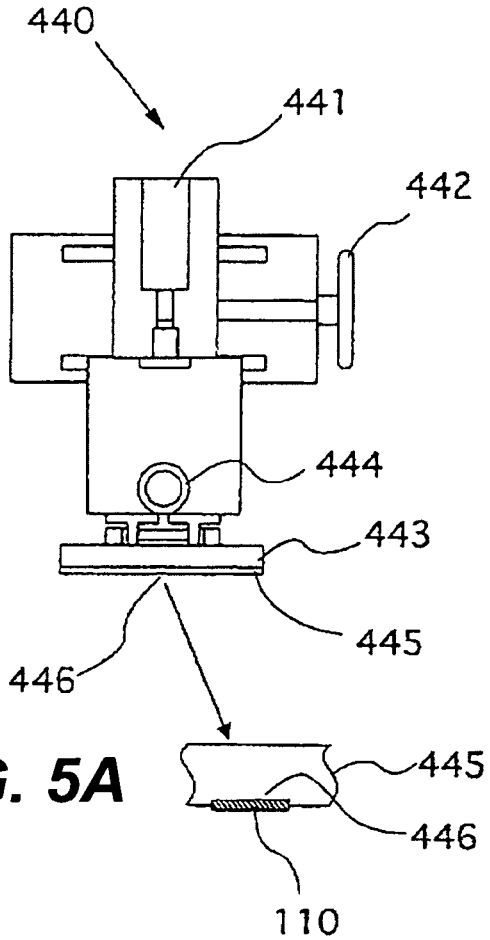
FIGS. 5A and 5B are respectively a front view and a side view of the pressing mechanism used in the polishing system of this invention.
Figure 5B:
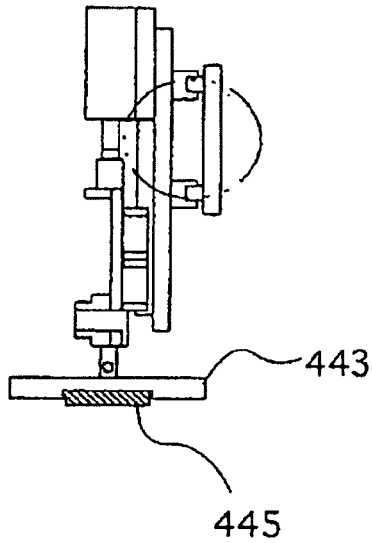

Next, the pressing mechanism 440 is explained. FIGS. 5A and 5B are respectively a front view and a side view of the pressing mechanism 440 used in the polishing system of this invention. The pressing mechanism 440 comprises an air cylinder 441, a pressuring plate 443 and a holding plate 445 provided on the center line of the pressuring plate 443 along the direction of travel of the tape-like base material. The lower surface of the holding plate 445 is provided with a guide groove 446 corresponding to the width of the tape-like base material 110 for preventing positional displacement of the tape-like base material 110 during the polishing process. The holding plate 445 is appropriately exchangeable, according to the size (width and thickness) of the tape-like metallic base material 110. A handle 442 for adjusting position is connected to a side surface of the pressing mechanism 440 such that the center in the direction of the width of the tape-like metallic base material 110 can be matched with the center of the pressing mechanism 440. After that, the pressure from the air cylinder 441 is communicated to the tape-like base material 110 through the pressuring plate 443 and the holding plate 445. An adjusting screw 444 is further provided at an upper portion of the pressuring plate 443 for adjusting the parallel relationship of the pressuring plate 443 and the polishing table 413. The pressing mechanism is not limited to the above. A different kind of pressing mechanism may be used for the purpose of the invention.

The washing device comprises a washing nozzle 120*a*, water being ejected from this washing nozzle 120*a* as washing liquid. A washing liquid other than water may be used. A tape receiving roller 130*b* is provided on the downstream side of the washing nozzle 120*a*. If a plurality of stages of polishing station are used, it is preferable to provide a washing device on the downstream side of each polishing station. Polishing debris generated in the first polishing process can be removed by the washing device from the target surface of the tape-like metallic base material 110.

The tape-like metallic base material 110 is subjected to the first polishing process in the first polishing part 103 described above. According to the preferred embodiment of the polishing system of this invention shown in FIG. 1, the first polishing process is carried out in two stages. After the polishing head is rotated in the clockwise direction at the polishing station of the first stage to carry out a coarse polishing process, the polishing head is rotated in the counter-clockwise direction at the polishing station of the second stage to carry out an intermediate finishing process. It is preferable to use slurry obtained from abrading particles, water and a mixture of water and an additive such as a lubricant and a dispersant at the time of a polishing process. This is referred to as a wet polishing method. $SiO_2$, $Al_2O_3$, diamond, cBN and SiC may be used as abrading particles.

According to an example, abrading particles with average diameter 0.05-3.0 μm are used in the first stage of the polishing process and those with average diameter 0.03-0.2 μm are used in the second stage. As another example, the same kind of abrading particles may be used both in the first stage and in the second stage of the polishing process.

The average surface roughness Ra of the tape-like metallic base material 110 after the first polishing process is preferably 10 nm or less and preferably 5 nm or less. Random polishing marks are formed on the target surface of the tape-like metallic base material 110.

The tape-like metallic base material 110 which has been randomly polished at the first polishing part 103 is thereafter subject to the second polishing process at the second polishing part 104.

The second polishing part 104 comprises at least one polishing station (two stations 104*a* and 104*b* being shown in FIG. 1) each having a polishing head 610 and a pressing mechanism 440 and at least one washing device 120*c* provided on the downstream side of the polishing station.

Figure 6A:
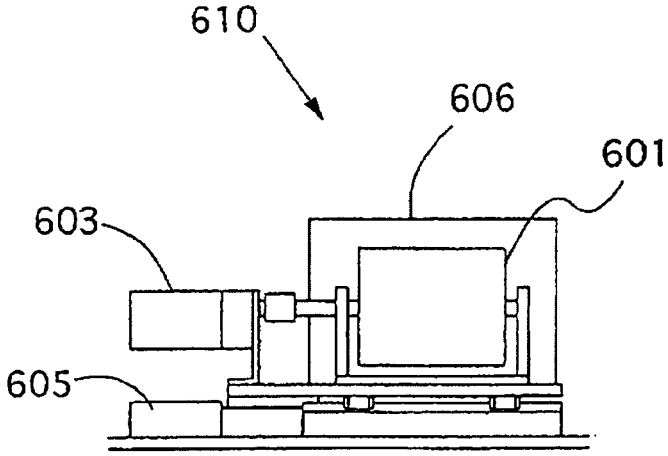
FIGS. 6A and 6B are respectively a front view and a side view of a polishing head used in the second polishing part of the polishing system of this invention.
Figure 6B:
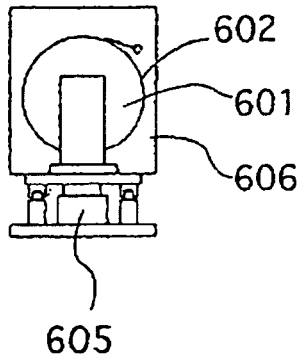

FIGS. 6A and 6B are respectively a front view and a side view of a preferred embodiment of polishing head 610 used in the second polishing part of the polishing system of this invention. The polishing head 610 comprises a cylindrical drum 601 obtained, for example, by winding a resin sheet 602 around a cylindrical drum base made of stainless steel, a driving motor 603 for rotating the cylindrical drum 601 and a driving mechanism (not shown) such as a driving ring. Foamed urethane, a woven cloth or a non-woven cloth may be used as the resin sheet 602. The cylindrical drum 601 is contained inside a housing 606. A motor 605 for causing the cylindrical drum 601 to undergo an oscillatory motion in a direction perpendicular to the direction of travel of the tape-like base material 110 may additionally be included. This oscillatory motion can prevent the tape-like metallic base material 110 from being polished at one same place on the cylindrical drum 601. It is preferable to supply the aforementioned slurry onto the resin sheet 602 at the time of the polishing process.

Figure 7A:
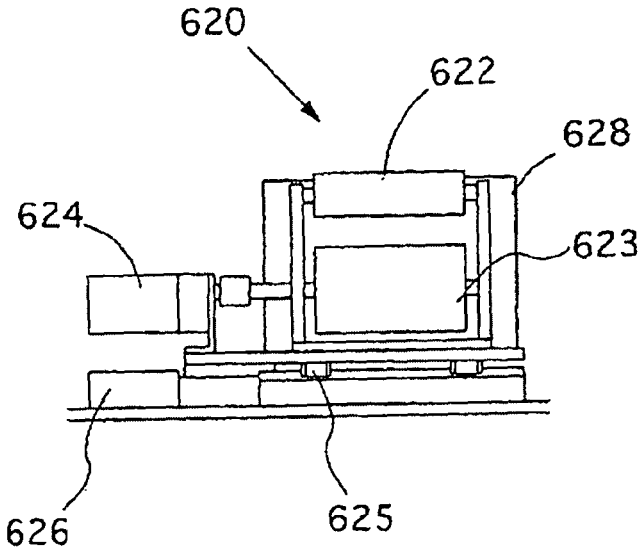
FIGS. 7A and 7B are respectively a front view and a side view of another embodiment of polishing head used in the second polishing part of the polishing system of this invention.
Figure 7B:
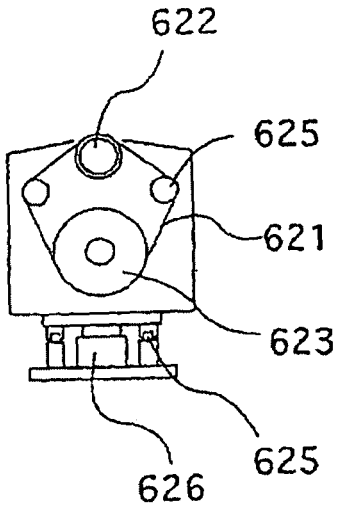

FIGS. 7A and 7B are respectively a front view and a side view of another embodiment of polishing head 620 used in the second polishing part of the polishing system of this invention. The polishing head 620 comprises a contact roller 622 for pressing a polishing belt 621 onto the tape-like base material 110, a polishing belt driving means 623, a supporting roller 625 and a driving motor 624 connected to the polishing belt driving means 623. The contact roller 622, the supporting roller 625 and the polishing belt driving means 623 are contained inside a housing 628. A woven or non-woven cloth of synthetic fibers or a tape made of a foamed member may be used as the polishing belt 621. As the driving motor 624 is operated, the polishing belt 621 travels through the contact roller 622 and the supporting roller 625 and polishes the target surface of the tape-like base material 110. It is preferable to supply the aforementioned slurry onto the polishing belt 621 at the time of the polishing process. A motor 626 for causing the contact roller 622 to undergo an oscillatory motion in a direction perpendicular to the direction of travel of the tape-like base material 110 may additionally be included. This oscillatory motion can prevent the tape-like metallic base material 110 from being polished at one same place on the polishing belt 621.

An important characteristic of the aforementioned polishing heads 610 and 620 is that the polishing surface of the cylindrical drum or the polishing belt 621 rotates in the direction of or opposite to the travel of the tape-like base material 110. The polishing heads 610 and 620 each comprise a polishing station together with the pressing mechanism 440 described with reference to FIG. 5 (FIGS. 5A and 5B). A plurality of stages of polishing station may be arranged in series for the second polishing process. In such an arrangement, it is preferable to set a washing device as described above on the downstream side of each polishing station.

In the second polishing part 104 described above, the tape-like metallic base material 110 is subjected to the second polishing process. According to the preferred embodiment of the polishing system shown in FIG. 1, the second polishing process is carried out in two stages. To start, the polishing drum of the first stage polishing station is rotated opposite to the direction of travel of the tape-like base material for polishing and then the polishing drum of the second stage polishing station is rotated opposite to the direction of travel of the tape-like base material for polishing. It is preferable to use slurry comprising abrading particles, water and a mixture of water and an additive such as a lubricant and a dispersant at the time of the polishing process. $SiO_2$, $Al_2O_3$, diamond, cBN, SiC and colloidal silica may be used as abrading particles. The average diameter of the abrading particles to be used is 0.02-0.1 μm and preferably 0.02-0.07 μm.

After the second polishing process, the average surface roughness Ra of the tape-like metallic base material 110 is 5 nm or less and more preferably 1 nm or less. Polishing marks are also formed in the longitudinal direction on the polished surface of the tape-like metallic base material 110.

Figure 8:
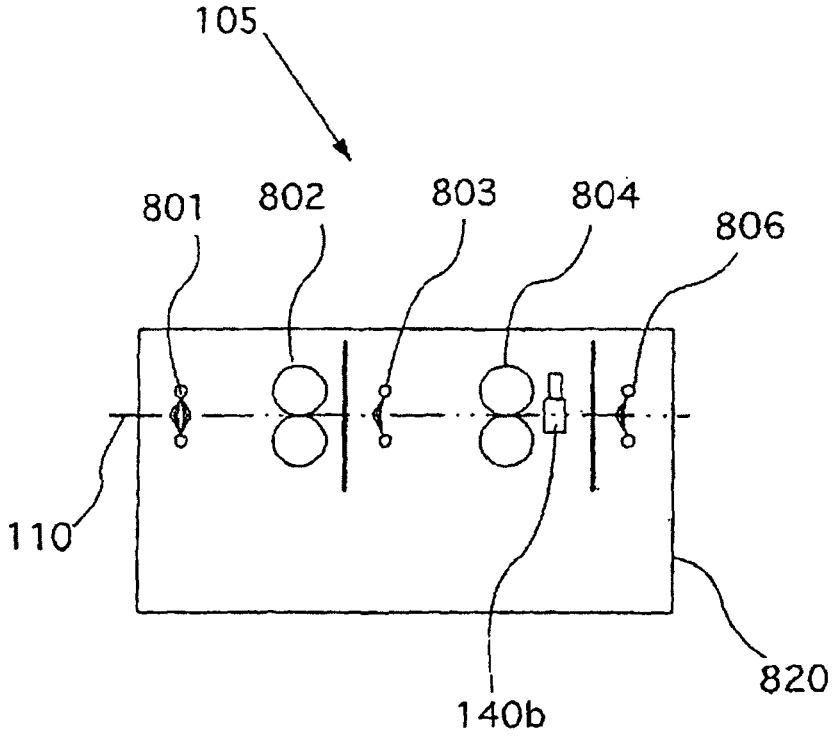
FIG. 8 shows a washing device used in the polishing system of this invention.

The tape-like base material 110 which has passed through the second polishing part 104 is subjected to a final washing process in the washing part 105. A preferred example of the washing part 105 used in the polishing system of this invention is schematically shown in FIG. 8. The washing device 105 comprises washing nozzles 801, brush rollers 802, air nozzles 803 and 806, and wiping rollers 804. The washing nozzles 801 include upper and lower nozzles through which ion exchange water or distilled water is ejected. The aforementioned width-regulating guide member 140*b* may also be disposed appropriately. The final washing device 105 is preferably contained inside a housing 820.

Figure 9A:
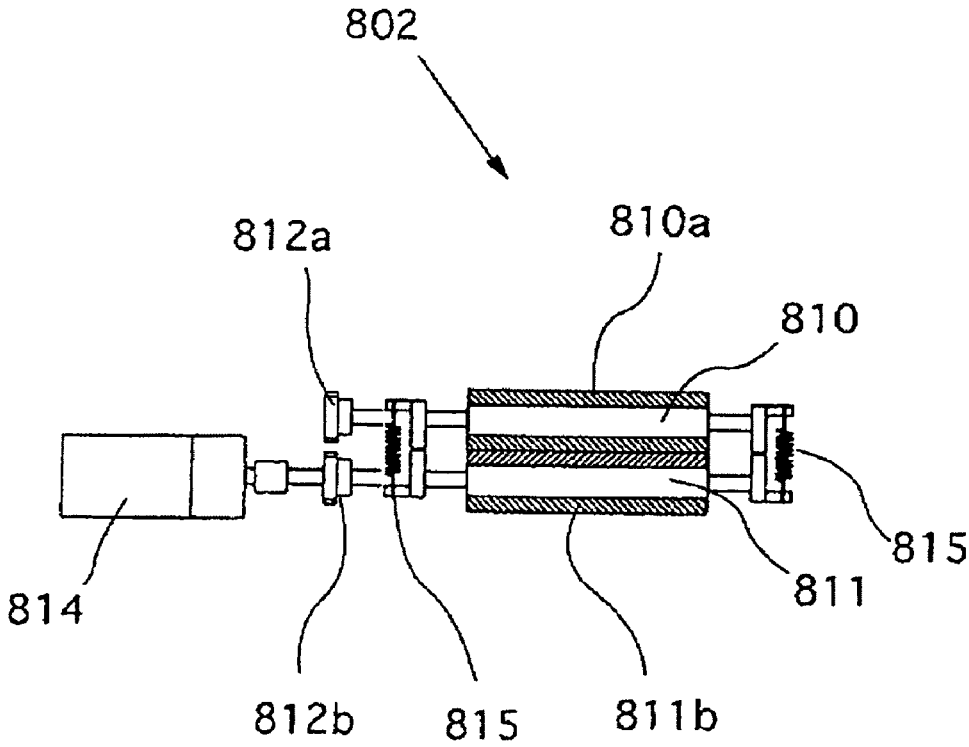
FIGS. 9A and 9B are respectively a front view and a side view of the brush roller part of the washing device of FIG. 8.
Figure 9B:
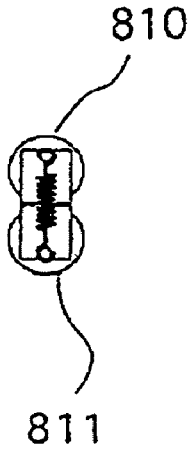

FIGS. 9A and 9B are respectively a front view and a side view of the brush rollers 802. The brush rollers 802 comprise two mutually parallel stainless steel shafts 810 and 811, a driving motor 814 and gears 812*a* and 812*b*. Brush sheets 810*a* and 811*b* made of nylon fibers, for example, are attached to the outer surfaces of the stainless steel shafts 810 and 811. Springs 815 for adjusting the pressure between the roller brushes are additionally provided at both ends of the shafts.

The final washing process by using this final washing device 105 is explained next. The tape-like base material 110 is firstly washed with water through the washing nozzles 801. Next, solid substances remaining after the washing with water are removed by the brush rollers 802. Next, air from the air nozzles 803 is blown on to remove the water components on the surfaces of the tape-like base material 110. Next, the wiping rollers 804 squeeze off the remaining water components on the tape-like base material 110. Finally, air is blown out of the air nozzles 806 to completely dry the tape-like base material 110.

After the final washing process, the tape-like metallic base material 110 is inspected for its surface roughness Ra and polishing marks. Ra may be measured by a conventional method such as atomic force microscopy (AFM) and the polishing marks may be observed by using an inspection device such as Micro-MAX and VMX-2100 (trade names) produced by Vision Psytec Corporation. If the results of the observation are not within a desired range, the tension of the tape-like base material, the positions and the number of the width-regulating guide members, the traveling speed of the tape-like base material, the number of pressure of the polishing station and the rotational speed of the polishing head are appropriately adjusted.

The description of the polishing system and the polishing method of this invention given above is not intended to limit the scope of the invention. Although the total length of the foot print of the polishing system described in FIG. 1 is about 6 m and the length from the back tension part 102 to the tape transporting part 106 is about 4 m, the foot print may be made longer or shorter, depending upon the number of the polishing stations.

Next, a test carried out by using a polishing system of this invention to polish a tape-like metallic base material will be described.

1. Conditions of the Test:

(1) Tape-like metallic base material: Nickel alloy (Ni: 58.0 wt %; Cr: 15.5 wt %; Fe: 5.0 wt %; W: 4.0 wt %; also containing Co, etc.), width 10 mm, length 100 m and thickness 0.1 mm (2) First Polishing Process Polishing tape: Tape with width 150 mm and thickness 500 μm with foamed urethane formed on a PET film Rotational speed of polishing head (rpm): 30-80 (first stage) and 30-80 (second stage)

Direction of rotation: Clockwise (first stage) and counter-clockwise (second stage)

Applied pressure (g/cm$^2$): 100-500 (first stage) and 100-500 (second stage)

Flow rate of slurry (ml/min): 5-30 (first stage) and 5-30 (second stage)

(3) Second Polishing Process

Pad on cylindrical drum: Non-woven cloth of polyester fibers

Rotational speed of polishing head (rpm): 20-60 (first stage) and 20-60 (second stage)

Direction of rotation: Against direction of travel (first stage) and against direction of travel (second stage)

Applied pressure (g/cm$^2$): 100-300 (first stage) and 100-300 (second stage)

Flow rate of slurry (ml/min): 5-30 (first stage) and 5-30 (second stage)

(4) Polishing materials: $Al_2O_3$ abrading particles with DEMOL EP (trade name) of Kao Chemical Company, adjusted to pH2-6, polycrystalline diamond abrading particles (20 wt %-50 wt % aqueous solution with glycol compounds, glycerol and fatty acid added, pH6-8), slurry with colloidal silica abrading particles aqueous solution (pH8-10) with addition of ammonium oxalate, potassium oxalate, glycerol and DEMOL EP ((trade name) of Kao Chemical Company.

(5) Polishing conditions: Tests were repeated by varying the type, particle size and contents in slurry of the polishing material and the feeding speed of the tape-like metallic base material. Table 1 shows these conditions in detail.

2. Results

Table 2 summarizes the results of the test.

This shows that the polishing system of this invention can obtain the final surface roughness Ra of 5 nm or less at a high feeding speed of 60 m/h. It also shows that polishing marks can finally be formed in the longitudinal direction and hence that surface polishing with high crystalline orientation (directionality) can be accomplished.

TABLE 1

| | First polishing process | | Second polishing process | | Feed speed of base material |
|---|---|---|---|---|---|
| | First stage | Second stage | First stage | Second stage | (m/h) |
| Test Example 1 | $Al_2O_3$ 3.0-0.5 μm 3 wt % | $Al_2O_3$ 0.5-0.1 μm 3 wt % | Polycrystalline diamond 0.1-0.05 μm 0.3 wt % | Polycrystalline diamond 0.1-0.05 μm 0.3 wt % | 60 |
| Test Example 2 | $Al_2O_3$ 1.0-0.5 μm 3 wt % | $Al_2O_3$ 0.5-0.1 μm 3 wt % | Colloidal silica 0.2-0.1 μm 5 wt % | Colloidal silica 0.05-0.03 μm 5 wt % | 20 |
| Test Example 3 | Polycrystalline diamond 1.0-0.5 μm 0.3 wt % | Polycrystalline diamond 0.3-0.1 μm 0.3 wt % | Polycrystalline diamond 0.1-0.05 μm 0.3 wt % | Polycrystalline diamond 0.1-0.05 μm 0.3 wt % | 60 |
| Test Example 4 | Polycrystalline diamond 0.5-0.2 μm 0.5 wt % | Polycrystalline diamond 0.3-0.1 μm 0.5 wt % | Polycrystalline diamond 0.1-0.03 μm 0.3 wt % | Polycrystalline diamond 0.1-0.03 μm 0.3 wt % | 40 |
| Test Example 5 | Polycrystalline diamond 0.3-0.1 μm 0.5 wt % | Polycrystalline diamond 0.1-0.05 μm 0.5 wt % | Colloidal silica 0.1-0.03 μm 5 wt % | Colloidal silica 0.1-0.03 μm 5 wt % | 20 |

TABLE 2

| | First polishing process | | Second polishing process | |
|---|---|---|---|---|
| | Surface roughness (nm) | Shape of polishing marks | Surface roughness (nm) | Shape of polishing marks |
| Test Example 1 | 10-5 | Random | 5-2 | Longitudinal |
| Test Example 2 | 5-2 | Random | 2-0.5 | Longitudinal |
| Test Example 3 | 10-2 | Random | 5-1 | Longitudinal |
| Test Example 4 | 7-5 | Random | 3-1 | Longitudinal |
| Test Example 5 | 5-3 | Random | 2-0.5 | Longitudinal |

What is claimed is:

1. A polishing system for continuously polishing a target surface of a tape-shaped metallic base material, said base material, an intermediate layer with controlled crystalline orientation on said target surface of said base material and a superconducting oxide layer on said intermediate layer together being adapted to form a superconducting oxide member, said polishing system comprising:

a feeding device for causing said base material to travel continuously;

a pressing device for applying a specified tension in said base material;

a first polishing device for carrying out an initial polishing of said target surface by performing a random rotational polishing and thereby removing scratches, protrusions or crystalline defects on said target surface generated on said base material by a rolling process; and a second polishing device for carrying out a final polishing on said target surface in the direction of travel of said base material and thereby increasing crystalline directionality in a longitudinal direction of said base material and flattening said target surface wherein polishing marks are formed in said direction of travel on said target surface by said final polishing.

2. The polishing system of claim 1 wherein said first polishing device includes a polishing station that comprises:

a polishing head that causes a polishing tape which is continuously sent out to rotate around an axial line perpendicular to said target surface; and a pressing mechanism for pressing said tape-shaped metallic base material onto said polishing tape.

3. The polishing system of claim 1 wherein said second polishing device includes a polishing station that comprises:

a polishing head having a cylindrical polishing drum that rotates in the direction of travel of said base material; and a pressing mechanism for pressing said tape-shaped metallic base material onto said polishing drum.

4. The polishing system of claim 1 wherein said first polishing device includes a polishing station that comprises:

a polishing head having a polishing pad that is attached to a platen and a mechanism for causing said polishing pad to rotate around an axial line perpendicular to said target surface; and a pressing mechanism for pressing said tape-shaped metallic base material onto said polishing pad.

5. The polishing system of claim 1 wherein said second polishing device includes a polishing station that comprises:

a polishing head having a tape member that rotates in the direction of travel of said tape-shaped metallic base material; and a pressing mechanism for pressing said tape-shaped metallic base material onto said tape member.

6. The polishing system of claim 2 wherein said polishing station has a first stage and a second stage each including a polishing head, the polishing head of said first stage and the polishing head of said second stage rotating in mutually opposite directions.

7. The polishing system of claim 3 wherein said polishing station has a first stage and a second stage each including a polishing head, the polishing head of said first stage and the polishing head of said second stage rotating in a direction opposite to said direction of travel.

8. The polishing system of claim 1 further comprising a washing device that washes said tape-shaped metallic base material after undergoing a polishing process.

9. The polishing system of claim 1 further comprising a width-regulating member that prevents positional displacement of said tape-shaped metallic base material.

10. The polishing system of claim 1 further comprising an inspection device for observing conditions of said target surface after undergoing a polishing process.

11. The polishing system of claim 1 wherein said tape-shaped metallic base material is selected from the group consisting of nickel, nickel alloys and stainless steel, having a width of 2 mm-100 mm, a length of 100 m-1000 m and a thickness of 0.05 mm-0.5 mm.

12. A method of polishing a tape-shaped metallic base material by using a polishing system according to claim 1, said method comprising:

the process of causing said base material to travel by said feeding device at a speed of 20 m/h or faster;

a first polishing process of carrying out an initial polishing of said target surface of said base material by performing a random rotational polishing by said first polishing device and thereby removing scratches, protrusions or crystalline defects on said target surface generated on said base material by a rolling process; and a second polishing process of polishing said target surface in the direction of travel of said base material by said second polishing device and thereby increasing crystalline directionality in a longitudinal direction of said base material and flattening said target surface.

13. The method of claim 12 further comprising the process of supplying slurry as said target surface is polished.

14. The method of claim 13 wherein said slurry comprises abrading particles, water and a mixture obtained by adding an additive to water, said abrading particles being of one kind or more selected from the group consisting of $Al_2O_3$, $SiO_2$, colloidal silica, fumed silica, monocrystalline and polycrystalline diamond, cBN and SiC.

15. The method of claim 14 wherein the average particle diameter of said abrading particles in the slurry used in said first polishing process is 0.05 μm-3 μm and the average particle diameter of said abrading particles in the slurry used in said second polishing process is 0.03 μm-0.2 μm.

16. The method of claim 12 wherein said first polishing process includes the step of polishing said target surface such that the average surface roughness Ra of said target surface becomes 10 nm or less.

17. The method of claim 12 wherein said second polishing process includes the step of polishing said target surface such that the average surface roughness Ra of said target surface becomes 5 nm or less and forming polishing marks on said target surface in the direction of travel of said base material.

18. The method of claim 12 further comprising the step of washing said base material after said polishing processes.

* * * * *